United States Patent [19]

Pokladnik

[11] Patent Number: 4,460,047

[45] Date of Patent: Jul. 17, 1984

[54] LATERALLY RELEASABLE CONNECTOR BETWEEN OUTER WELL MEMBER AND TEMPLATE

[75] Inventor: Roger L. Pokladnik, Houston, Tex.

[73] Assignee: Armco Inc., Middletown, Ohio

[21] Appl. No.: 422,092

[22] Filed: Sep. 23, 1982

[51] Int. Cl.[3] ..... E21B 33/038

[52] U.S. Cl. ..... 166/341; 166/355; 285/2

[58] Field of Search ..... 166/341, 355, 349, 339, 166/85, 368, 382; 285/2, 3, 4, 140–143; 175/7

[56] References Cited

U.S. PATENT DOCUMENTS

| | | | |
|---|---|---|---|
| 1,929,635 | 10/1933 | Goff | 285/266 |
| 2,646,294 | 7/1953 | Anderson | 285/165 |
| 2,808,229 | 10/1957 | Bauer et al. | 175/7 |
| 3,244,424 | 4/1966 | Cope | 285/165 |
| 3,486,555 | 12/1969 | Vincent | 175/7 |
| 3,782,458 | 1/1974 | Slack | 166/355 |
| 4,053,022 | 10/1977 | Mercier | 175/7 |

*Primary Examiner*—Ernest Purser
*Assistant Examiner*—Hoang C. Dang
*Attorney, Agent, or Firm*—Roylance, Abrams, Berdo & Goodman

[57] ABSTRACT

In underwater well installations of the type in which a template or like rigid base structure at the floor of a body of water defines a well opening, and an outer well member such as a suspension joint secured in the borehole projects upwardly within the well opening, the outer well member is connected to the template by a structure which restrains the outer well member from moving laterally relative to the base structure until the force tending to cause such lateral movement exceeds a predetermined large value, after which point the connection serves as a lost motion connection allowing the outer well member to move laterally through a limited excursion relative to the template.

6 Claims, 3 Drawing Figures

2
2
3
3
22
20
21
19
19
4
5
10
23
6
1
3
7
8

22
21
20
19
4
1
13
14
29
11
29
27
26
15
28
16
17
28
18
24
25
23
12
10
10
6
3

LATERALLY RELEASABLE CONNECTOR BETWEEN OUTER WELL MEMBER AND TEMPLATE

This invention relates to underwater well apparatus and particularly to connections between a well component, typically the suspension joint, and a template or like rigid base structure.

BACKGROUND OF THE INVENTION

In drilling and completion of oil and gas wells under water, it has been conventional to provide an outer casing cemented into the upper portion of the borehole and from which other casing and tubing are supported via wellhead means secured to the top of the outer casing, the upper end length of the outer casing usually being referred to as a suspension joint. In commencing the borehole, it is necessary to provide at the floor of the body of water a template or other base structure which defines the position for a well, or for each well, to be drilled, the template or the like frequently defining a substantial plurality of positions, commonly called wellslots, so that a substantial number of wells can be drilled. For each wellslot there are secured to the template or the like a plurality of upstanding guide posts to each of which is attached one guide line of a multiple guide line system of the general type disclosed in U.S. Pat. No. 2,808,229, issued Oct. 1, 1957, to Bauer et al, the guide line system extending from the template to an operational base at the surface of the body of water. In drilling wells in relatively shallow water, it has been common practice to lower the outer casing through the wellslot into the borehole and land an external shoulder of the suspension joint on an upwardly directed shoulder presented by the template or the like at the wellslot, the suspension joint being latched in place so as to be rigidly connected to the template or the like and thus permanently restrained against lateral movement, that restraint resulting from the fact that the template or the like is a rigid structure and the suspension joint, having been landed on the shoulder at the wellslot, is in metal-to-metal engagement with the template or the like.

In recent times, it has become necessary to drill wells in deep water, e.g., at depths of at least 1,500 feet. In such cases, and even in shallower depths, the wellhead attached to the suspension joint is connected to the operational base at the water surface by a string of large diameter pipe, commonly called a drilling riser, during drilling and by a second string of such pipe, commonly called a production riser, during and after completion of the well. Such risers are subjected to water currents and other forces and, recognizing their length, tend to develop large lateral forces occurring between the suspension joint and the template or like base structure. Since the template or the like will not move laterally, typically being secured to the floor of the body of water by piles, all of the lateral forces act between the suspension joint, as a member urged laterally, and the stationary template or the like. For wells in relatively shallow water, such forces have been successfully accepted by the templates and the connection between that rigid structure and the suspension joint, even when tie-back risers have been used. For wells in particularly deep water, and particularly those drilled from a tension leg platform, it is necessary to provide some means for preventing such large lateral forces from causing damage to the lower end of the riser, the wellhead, the template or the connection between the suspension joint and the template or like base structure.

OBJECTS OF THE INVENTION

It is accordingly a general object of the invention to provide in such structures a connection between the template or the like and the suspension joint or other outer well member which will resist in rigid fashion all lateral forces applied via the suspension joint up to that point at which damage may occur and will then act as a lost motion connection with respect to lateral forces.

Another object is to provide such a connection which will at all times rigidly resist tension forces acting downwardly or upwardly on the suspension joint.

A further object is to provide such a connection which is particularly advantageous under the conditions presented when the well is to be established and operated from a tension leg platform.

SUMMARY OF THE INVENTION

The invention is applicable to all underwater well installations of the type comprising a template or like rigid base structure secured to the floor of the body of water and defining at least one well opening, and an outer well member such as a suspension joint secured in the borehole and extending upwardly within the well opening and adapted to have the lower end of a riser connected thereto. The invention is particularly applicable to deep water installations such as those established from a tension leg platform.

In all embodiments of the invention, the outer well member is connected to the rigid base structure by means which resist in rigid fashion all lateral forces applied from the outer well member to the rigid base structure until the lateral force reaches a predetermined magnitude, at which point the connection yields and serves as a lost motion connection allowing limiting movement of the outer well member laterally relative to the rigid base structure. In particularly advantageous embodiments, the template or other rigid base structure is equipped with a rigid annular member, typically a heavy integral ring, and a positioning structure, the positioning structure being rigidly secured to the template and defining a generally annular horizontally extending space surrounding and opening inwardly into the well opening, the rigid annular member being disposed within that generally annular space. In its normal operative position, the inner periphery of the rigid annular member is spaced inwardly of and concentric with the well opening of the template, and the outer periphery of the rigid annular member is spaced outwardly from the well opening. The rigid annular member is secured rigidly to the positioning structure, and thus to the template or other rigid base structure, by releasable securing means, advantageously comprising a plurality of shearable members spaced in an annular series concentric with the well opening and extending through an upper member which defines the upper wall of the generally annular space in which the ring or other rigid annular connecting member is disposed. The inner periphery of the rigid annular member directly embraces the outer well member. The outer periphery of the rigid annular member is spaced inwardly from a closed wall presented by the positioning structure and defining the outer limits of the space in which the rigid annular member is disposed, the outer periphery of the rigid annular member being generally concentric with the closed outer wall when the rigid annular member occupies its normal operative position. The releasable securing means is constructed and arranged to release the rigid annular member in response to occurrence of a lateral force of a predetermined large magnitude applied to the outer well member to the rigid annular member. Once so released, the rigid annular member, and therefore the outer well member, can move laterally relative to the template or other rigid base structure, the excursion of such movement being limited by the relative dimensions of the outer wall presented by the positioning structure and the outer periphery of the rigid annular member.

IDENTIFICATION OF THE DRAWINGS

In the drawings, which form part of the original disclosure of this application, FIG. 1 is a view partly in vertical cross section and partly in side elevation of an installation according to one particularly advantageous embodiment of the invention;

FIG. 2 is an enlarged fragmentary vertical cross-sectional view of a portion of the apparatus of FIG. 1, with portions shown in side elevation and some parts broken away for clarity of illustration; and FIG. 3 is a top plan elevational view of the apparatus of FIG. 1, taken generally on line 3—3, FIG. 1.

DETAILED DESCRIPTION OF THE INVENTION

Figure 1:
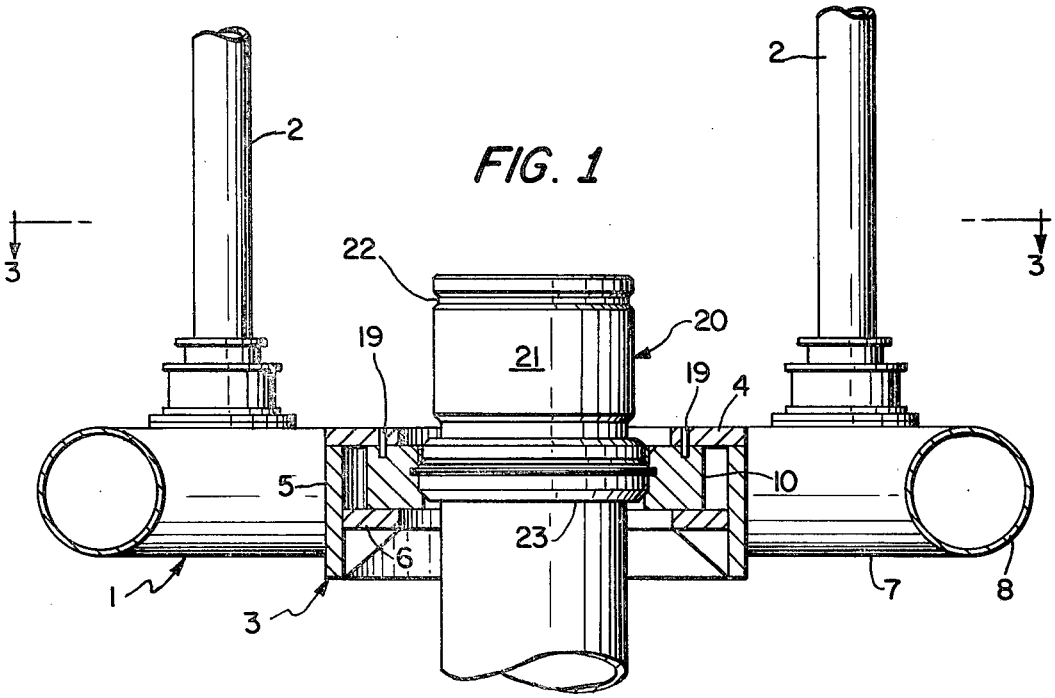
Figure 2:
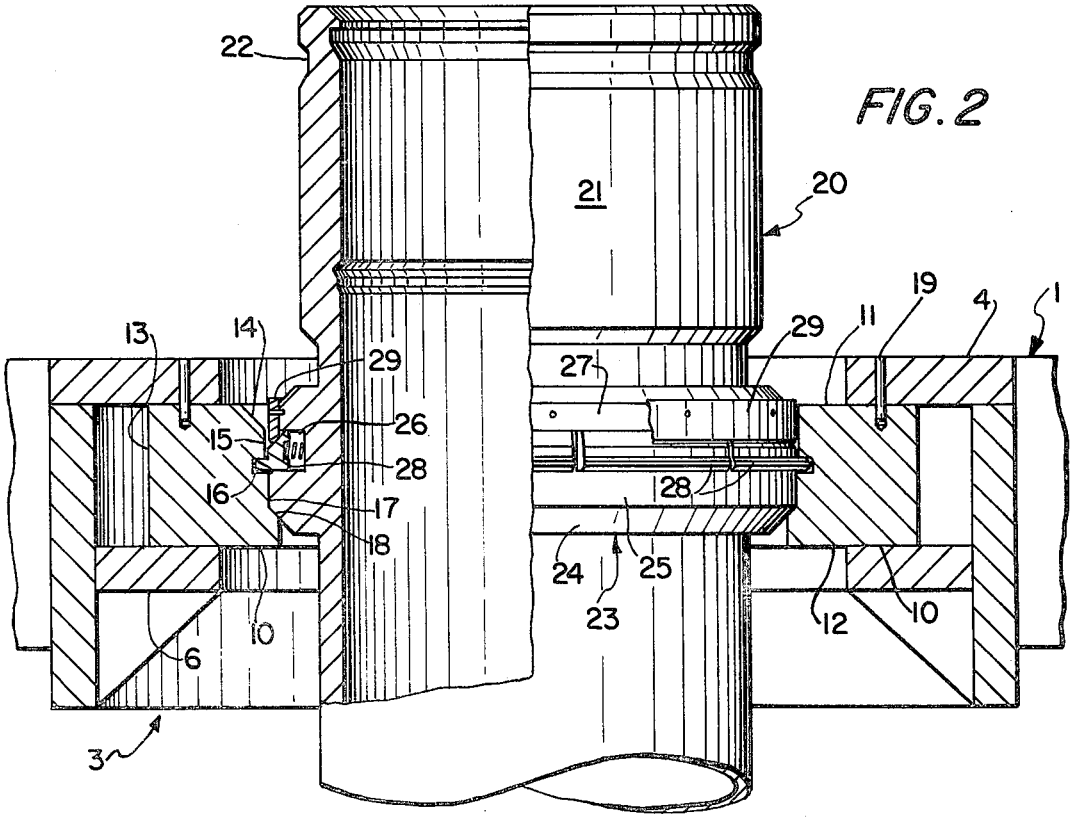
Figure 3:
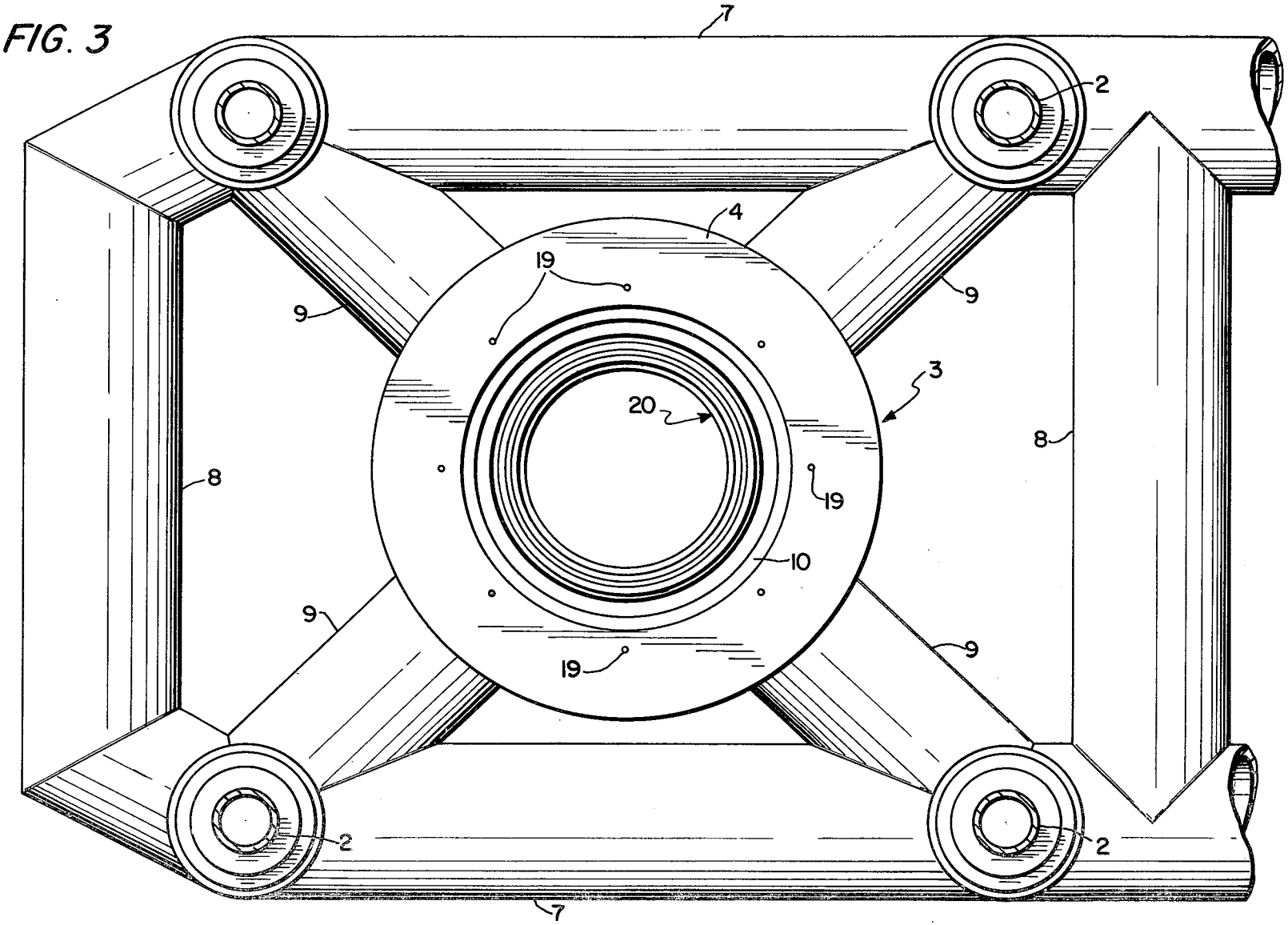

FIGS. 1–3 illustrate one embodiment of the invention as applied to an underwater well installation including a template, indicated generally at 1, which can be constructed in any suitable conventional fashion. For simplicity of illustration, only that upper portion of the template required to define the location for a single well opening is shown, and conventional frame structure and piling for securing the template to the ocean floor have been omitted. The template is equipped with four upstanding guide posts 2 which are spaced apart to define a rectangle centered on the well opening, the guide posts being rigidly secured to the template and each conventionally attached to a guideline (not shown) extending to the operation base (not shown) at the surface of the body of water for use in conventional fashion to guide tools and components to the well opening.

Rigidly secured to the template is a positioning structure, indicated generally at 3, comprising a flat annular upper member 4, an outer wall member 5 which is cylindrical and welded or otherwise secured to the outer periphery of member 4 so as to depend therefrom, and a flat annular lower member 6 spaced below and parallel to member 4, the outer periphery of member 6 being welded or otherwise secured to member 5. The inner peripheries of members 4 and 6 are circular, of the same diameter and coaxial, and define the well opening of the template. The top of template 1 is defined by side members 7 and cross member 8. Positioning structure 3 is centered between side members 7, and centered with respect to the rectangle defined by the positions of guide posts 2, and is rigidly supported by structural members 9 which extend along the diagonals of that rectangle and are welded both to member 5 and side members 7. Members 4–6 define a horizontally extending annular space which surrounds and opens inwardly into the well opening defined by the inner peripheries of members 4 and 6. Disposed within that space is a rigid integral metal ring, indicated generally at 10, having a flat upper surface 11 and a flat lower surface 12, the outer peripheral surface 13 of the ring being right cylindrical. The inner peripheral surface of the ring is concentric with surface 13 and, as best shown in FIG. 2, comprises an upper frustoconical guide portion 14 which tapers downwardly and inwardly, a right cylindrical surface portion 15 joining the bottom end of portion 14, a transverse annular inwardly opening latching groove 16, a right cylindrical surface portion 17 of somewhat smaller diameter than portion 15, and a frustoconical shoulder 18 which tapers downwardly and inwardly and is therefore upwardly directed when the ring is in operative position. The outer periphery of ring 10 is of a diameter larger than that of the inner peripheries of members 4 and 6. The inner periphery of the ring is of a diameter smaller than that of the inner peripheries of members 4 and 6. Upper surface 11 of the ring is disposed in sliding engagement with the flat lower face of member 4. Lower surface 12 of the ring is disposed in sliding engagement with the flat upper face of member 6.

The combination of template 1, positioning structure 3 and ring 10 is assembled at the operational base before lowering of the template onto the floor of the body of water. At the time of assembly, ring 10 is adjusted in its accommodating space until concentric with the well opening defined by the inner peripheries of members 4 and 6, such adjustment bringing into respective registry a circular series of upwardly opening blind bores in the ring and a like circular series of through bores in member 4. With the ring thus positioned relative to positioning structure 3, a plurality of shear pins 19 are installed with each shear pin extending through a different one of the through bores in member 4 and into the corresponding blind bore in the ring. The member and strength of the shear pins is selected to assure rigid connection of the ring to positioning structure 3 by the shear pins under all lateral forces up to a predetermined maximum, forces in excess of the predetermined maximum being effective to break all of the shear pins and free ring 10 for lateral sliding motion within the space defined by members 4–6.

As an outer well member, the installation includes a suspension joint indicated generally at 20 landed on and latched to ring 20. In this embodiment, suspension joint 20 includes an upper hub 21 having an external groove 22 to coact with a conventional remotely operated connector for securing to the suspension joint the lower end of the drilling riser (not shown). Spaced below hub 21 is a second hub or annular enlargement 23 the outer surface of which includes a downwardly directed transverse annular shoulder 24 which is frustoconical, tapers downwardly and inwardly, and is dimensioned for flush engagement with shoulder 18 to support the suspension joint on ring 10 and thus on the template. Above shoulder 24, the outer periphery of hub 23 includes in series a right cylindrical portion 25 of slightly smaller diameter than surface portion 17 of the ring, a transverse annular outwardly opening segment retaining groove 26 opposed to latching groove 16 when shoulder 24 has landed on shoulder 18, and an upper right cylindrical surface portion 27 of significantly smaller diameter than surface portion 15 of the ring. Groove 26 accommodates an annular series of latching segments 28 which are spring-biased outwardly and retained within groove 26 by a ring 29 which can be driven downwardly by a remotely operated tool (not shown) to retract the latching segments. Segments 28, ring 29, groove 26 and groove 16 are constructed and arranged generally in the manner disclosed in detail in U.S. Pat. No. 4,290,483, issued Sept. 22, 1981, to John E. Lawson and serve to latch the suspension joint to ring 10 in such fashion as to provide metal-to-metal restraint against displacement of the suspension joint upwardly or downwardly relative to the ring. Since the upper face of ring 10 is in flush engagement with the lower surface of member 4, and the lower face of the ring is in flush engagement with the upper face of member 6, such latching of the suspension joint to ring 10 is effective to restrain the suspension joint against upward or downward displacement relative to template 1. Though surface portion 27 is spaced inwardly from the ring in order to freely accommodate the segment retracting ring 29, surface portion 17 of ring 10 directly embraces surface portion 25 of the suspension joint, and shoulders 18 and 24 are in flush engagement, so that forces applied to the suspension joint, as by a riser connected thereto, and tending to displace the suspension joint laterally are directly resisted in metal-to-metal fashion by ring 10, so long as shear pins 19 remain intact.

Once the shear pins have been broken, ring 10 is free to move laterally relative to positioning structure 3, and the connection thereafter functions in lost motion fashion so far as the lateral forces applied by the suspension joint are concerned, the excursion of lateral movement being limited by the relative dimensions of the outer wall of the positioning structure and the outer periphery of ring 10. However, since the suspension joint remains latched to ring 10 by segments 28, and ring 10 is vertically restrained between members 4 and 6, the connection continues to restrain against relative vertical movement between the suspension joint and the template.

It will be apparent that various changes in the structure can be made without departing from the scope of the invention. Thus, instead of extending downwardly through bores in member 4 to engage in upwardly opening bores in ring 10, shear pins 19 can extend upwardly through bores in member 6 to engage in downwardly opening bores in ring 10.

What is claimed is:

1. In an underwater well installation of the type comprising a rigid base structure secured to the floor of the body of water and defining the location for a well opening, the well including a borehole in which an outer well member is secured and extends upwardly at the location for the well opening, the combination of a positioning structure rigidly secured to the base structure and defining both the well opening and an annular horizontally extending space which surrounds the well opening and opens toward the outer well member, the positioning structure including an outer wall which extends completely around said annular horizontally extending space and defines the outer limits thereof;

a rigid annular member having an inner periphery which directly embraces the outer well member and also having an outer periphery which is directed away from the outer well member, said rigid annular member being disposed within the annular horizontally extending space defined by the positioning structure with the inner periphery of the rigid annular member spaced inwardly from and concentric with the well opening and the outer periphery of the rigid annular member spaced inwardly from the outer wall of the positioning structure; and releasable securing means interconnecting said rigid annular member and said positioning structure and securing said rigid annular member against lateral movement relative to the positioning structure, said securing means being constructed and arranged to release said rigid annular member for lateral movement relative to the rigid base structure in response to occurrence of a lateral force of predetermined magnitude applied to the rigid annular member by the outer well member, the excursion of such movement then being limited by said positioning structure.

2. The combination defined by claim 1, wherein the rigid annular member is an integral heavy ring and the inner periphery of the ring includes a transverse annular upwardly directed shoulder upon which the outer well member is seated.

3. The combination defined by claim 2, wherein the positioning structure includes an upper annular member having a flat lower surface and a lower annular member having a flat upper surface; and said ring includes flat upper and lower surfaces slideably engaged respectively with the flat surfaces presented by the upper and lower members of the positioning structure.

4. The combination defined by claim 3, wherein said releasable securing means comprises a plurality of shear members carried by one of said upper and lower members of the positioning structure and spaced in an annular series concentric with the well opening.

5. The combination defined by claim 4, wherein the well opening is defined by said upper and lower members of the positioning structure.

6. In an underwater well installation of the type comprising a rigid base structure secured to the floor of the body of water and defining the location for a well opening, and an outer well member secured in the borehole of the well and extending upwardly within the base structure, the combination of rigid annular means directly embracing the outer well member;

positioning means rigidly carried by the base structure and defining both the well opening and a horizontally extending space surrounding and opening inwardly toward the outer well member, said rigid annular means being disposed within said horizontally extending space and being directly engaged by said positioning means for restraint against vertical movement relative to the base structure; and releasable securing means interconnecting said rigid annular means and said positioning means to secure said rigid annular means in a position coaxial with the well opening, said securing means being constructed and arranged to release said rigid annular means for lateral movement in response to occurrence of a lateral force of predetermined magnitude applied to said rigid annular means by the outer well member.

* * * * *